US008043151B2

(12) United States Patent
Pickelhaupt

(10) Patent No.: US 8,043,151 B2
(45) Date of Patent: Oct. 25, 2011

(54) TRADING GAME SIMULATION METHOD

(76) Inventor: Charles Pickelhaupt, Winchester, MA (US)

( * ) Notice: Subject to any disclaimer, the term of this patent is extended or adjusted under 35 U.S.C. 154(b) by 498 days.

(21) Appl. No.: 12/259,278

(22) Filed: Oct. 27, 2008

(65) Prior Publication Data

US 2010/0102509 A1 Apr. 29, 2010

(51) Int. Cl.
*G06F 17/00* (2006.01)

(52) U.S. Cl. ..... 463/11

(58) Field of Classification Search ..... 463/9–13, 463/16–25, 42; 705/35, 37; 273/148 R, 273/149 R, 149 P
See application file for complete search history.

(56) References Cited

U.S. PATENT DOCUMENTS 7,566,270 B2 * 7/2009 Amaitis et al. ..... 463/22
7,604,537 B2 * 10/2009 Amaitis et al. ..... 463/17
7,711,628 B2 * 5/2010 Davie et al. ..... 705/37
7,835,961 B2 * 11/2010 Davie et al. ..... 705/35
7,937,318 B2 * 5/2011 Davie et al. ..... 705/37
2006/0105839 A1 * 5/2006 Graeve et al. ..... 463/42
2006/0199631 A1 * 9/2006 McGill et al. ..... 463/16
2008/0027880 A1 * 1/2008 Yu ..... 705/36 R
2008/0032778 A1 * 2/2008 Amaitis et al. ..... 463/20

* cited by examiner

*Primary Examiner* — Ronald Laneau
(74) *Attorney, Agent, or Firm* — Lambert & Associates; Gary E. Lambert; David J. Connaughton, Jr.

(57) ABSTRACT

A trading simulation game that emulates the roles of market makers and traders involved in the securities market. The simulation allows for random market activity by specifying a starting market price and employing a subset of a pool of market-affecting items to modify the starting price and determine the final game price. Items in the subset are incrementally revealed to simulation participants during play, and designated participants may make the first offer to trade. All participants simultaneously make and accept offers to buy and sell the simulated security without restriction, based on the public and private information they have and their dynamic estimates of the final game price. Trades are tracked, and they are settled at the final game price when all items are revealed. The use of a subset of a pool of market-affecting items allows for probability-based strategy similar to popular card games like blackjack and poker.

7 Claims, 7 Drawing Sheets

| Trade With | Sell / Buy | Sell Price | - | Buy Price | = | + Gain / - Loss | * | Number of Shares | = | + Profit / - Loss |
|---|---|---|---|---|---|---|---|---|---|---|
| G | S B | | - | 99 | = | | * | 100 | = | |
| B | S B | | - | 97 | = | | * | 100 | = | |
| D | S B | 103 | - | | = | | * | 300 | = | |
| | S B | | - | | = | | * | | = | |
| | S B | | - | | = | | * | | = | |
| | S B | | - | | = | | * | | = | |
| | S B | | - | | = | | * | | = | |
| | S B | | - | | = | | * | | = | |
| | S B | | - | | = | | * | | = | |
| Total Last Column for Final Profit / Loss = | | | | | | | | | | |

TRADING GAME SIMULATION METHOD

FIELD OF THE INVENTION

The present invention relates to a market trading simulation. Various financial games have been created to entertain and to educate people about how financial markets work. The present invention provides the volatility, competition, and sophistication of an actual market. In a number of significant respects, this invention is an improvement on other market trading simulations.

BACKGROUND OF INVENTION

The trading simulation game emulates the roles of market makers and traders in a security market. The simulation employs a single pool of market-affecting items or electronic versions of the same, allowing random market activity with the benefit of probability-based strategies similar to that of popular card games like blackjack and poker.

The pool of items represents events that affect the final settlement price of the security being traded in the simulation. The events can vary based on the specific market being simulated, but events might include corporate news, economic indicators, legal proceedings, regulatory actions, marketing successes, global events, acts of God, etc. These items and the effects they have can be used in educational scenarios to teach the impact of the events on real market pricing.

The trading simulation begins at a given starting price, and a randomized subset of the pool of items is distributed to the players and optionally to a central depository. Items in the subset are incrementally revealed with rounds of the simulation, modifying the starting price for the security being traded. One or more participants in the simulation may optionally be given the responsibility of offering each round's first bid and ask prices for the security being traded. In each round, all participants simultaneously offer any number of dynamic bid and ask prices without restriction, based on the information each has that no one else has and their own estimates of the final game price. Any player may simultaneously accept an offer from any other player, thus buying and selling the agreed quantity of shares at any agreed price.

Each round ends when participants can no longer reach agreement on a price to trade, and then one or more of the distributed subset of market-affecting items are incrementally revealed. When all rounds of trading are completed, all items are revealed to all players, determining the final game price. Any open positions are closed at the final game price to determine participants' profits and losses. The participant with the most profit is the winner. If multiple participants have the identical highest profit, the game ends in a tie between those participants.

The trading simulation game offers numerous benefits over the prior art mechanisms. By setting a starting price and incrementally modifying that price with market-affecting items, negative prices can be avoided for realism and simplicity. The use of incrementally revealed private and shared items enables advanced probability-based game strategies. As in global markets, there are neither time limits on the rounds nor any restrictions on the offers that can be made, and all players participate simultaneously. The entire simulation can, in at least one embodiment, be entirely represented by a deck of cards with no other pieces or parts. In addition, the novel tally sheet makes tracking trades and calculating profits and losses significantly easier than in any prior art.

SUMMARY OF THE INVENTION

The instant invention, as illustrated herein, is clearly not anticipated, rendered obvious, or even present in any of the prior art mechanisms, either alone or in any combination thereof. The instant invention, a method of trade simulation gaming, has several novel and non-obvious approaches over previous simulation games. Thus the several embodiments of the invention are illustrated herein.

Therefore it is an object of the instant invention to provide a market trading simulation game that accurately simulates the activities of market makers and traders.

It is an object of the instant invention to provide a market trading simulation game that provides a market trading simulation of heightened interest.

It is an object of the instant invention to provide a market trading simulation game that can be adapted to various ability levels.

It is an object of the instant invention to provide a market trading simulation game that can serve to substantially educate participants about how the market being simulated actually works in a real world setting.

It is an object of the instant invention to provide a market trading simulation game that provides randomized play with calculable probabilities of particular items appearing.

It is an object of the instant invention to provide a market trading simulation game, wherein the unveiling of concealed items during the simulation grants participants insight into the simulation's final settlement price.

It is an object of the instant invention to provide a market trading simulation game, wherein all participants can make bids and trade with other participants in a substantially unrestricted a manner.

It is an object of the instant invention to provide a market trading simulation game, wherein all participants can make offers and trade with other participants in a substantially unrestricted a manner.

It is an object of the instant invention to provide a market trading simulation game, wherein a pre-determined starting price avoids the possibility of negative market prices.

It is an object of the instant invention to provide a market trading simulation game, wherein said simulation game comprises a small number of distinct pieces and parts.

It is an object of the instant invention to provide a computer-based market trading simulation game that accurately simulates the activities of market makers and traders.

It is an object of the instant invention to provide a computer-based market trading simulation game that provides a market trading simulation of heightened interest.

It is an object of the instant invention to provide a computer-based market trading simulation game that can be adapted to various ability levels.

It is an object of the instant invention to provide a computer-based market trading simulation game that can serve to substantially educate participants about how the market being simulated actually works in a real world setting.

It is an object of the instant invention to provide a computer-based market trading simulation game that provides randomized play with calculable probabilities of particular gaming items appearing.

It is an object of the instant invention to provide a computer-based market trading simulation game, wherein the unveiling of concealed items during the simulation grants participants insight into the simulation's final settlement price.

It is an object of the instant invention to provide a computer-based market trading simulation game, wherein all participants can make bids and trade with other participants in a substantially unrestricted a manner.

It is an object of the instant invention to provide a computer-based market trading simulation game, wherein all participants can make offers and trade with other participants in a substantially unrestricted a manner.

It is an object of the instant invention to provide a computer-based market trading simulation game, wherein a predetermined starting price avoids the possibility of negative market prices.

It is an object of the instant invention to provide a computer-based market trading simulation game, wherein said simulation game comprises a small number of distinct pieces and parts.

These together with other objects of the invention, along with various features of novelty which characterize the invention, are pointed out with particularity in the claims and Detailed Description of the Embodiments Sections, and drawings of this application, with all said sections also adding to this disclosure.

DETAILED DESCRIPTION OF THE DISCLOSED EMBODIMENTS

The detailed description set forth below in connection with the appended drawing is intended as a description of presently preferred embodiments of the invention and does not represent the only forms in which the present invention may be constructed and/or utilized. The description sets forth the functions and the sequence of steps for implementing the method set forth in the instant invention. However, it is to be understood that the same or equivalent functions and sequences may be accomplished by different embodiments that are also intended to be encompassed within the spirit and scope of the invention, such as implementing methods that include providing direct and indirect payments to a service provider, a central manager facilitating this method and clients as well as methods providing that said payments are flat rate or percentage based. Also alternative embodiments of the instant invention are intended to encompass service providers that provide any form of service to a client.

The embodiments of the instant invention realize a particular market trading simulation suitable for trade simulation gaming, wherein participants may not be in the same proximity and/or may posses individually unique desirable configurations. As partially illustrated in FIGS. 7 and 8, the instant trading simulation gaming invention allows for embodiments to facilitate gaming across a network, including but not limited to the Internet. Commonly, in any given embodiment of the instant invention, one participant's 2 perspective may be a graphically generated user interface to manage their own play, wherein the graphically generated user interface generates graphical depictions for other simulation participants. Note, in at least one embodiment of the instant invention each participant can have their own similar or distinct view of the same simulation, displaying any appropriate information involving the simulation.

Figure 1:
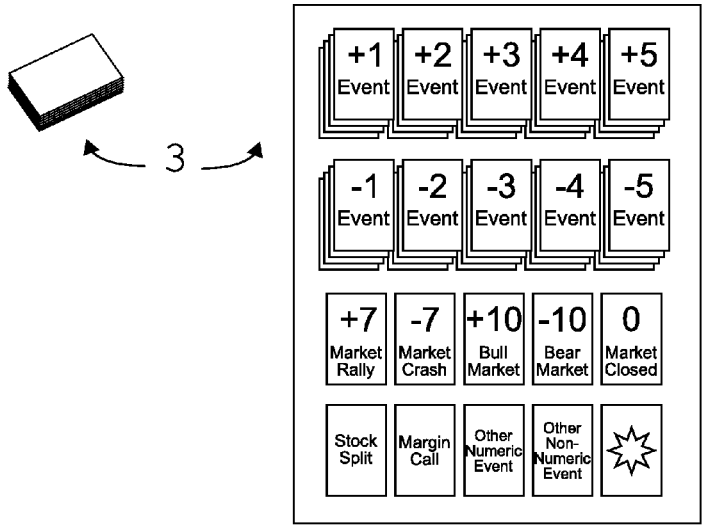
FIG. 1 illustrates one embodiment of the multi-player trading simulation, wherein various cards are depicted that represent various events and information designations.
Figure 2:
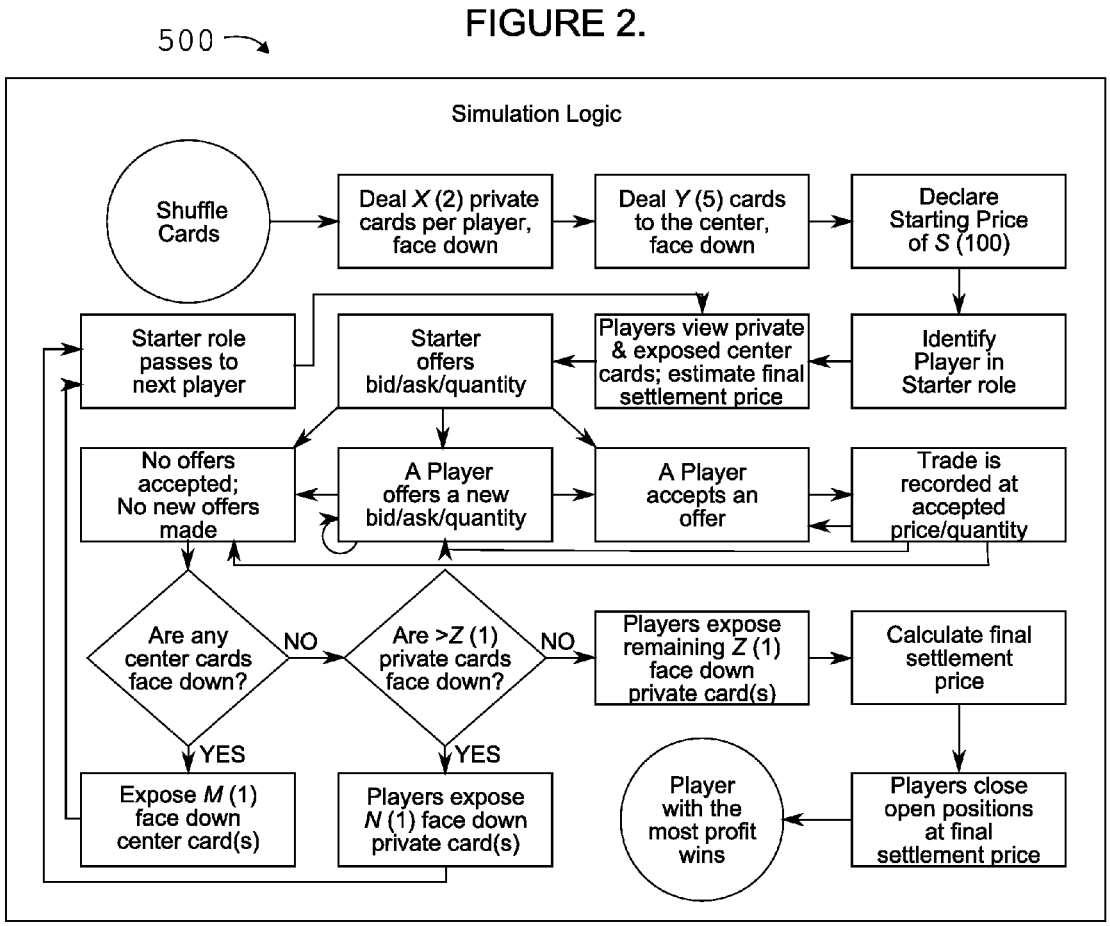
FIG. 2 illustrates a flow chart diagram of the various steps that are taken in the execution sequence of one embodiment of the instant invention.
Figure 3:
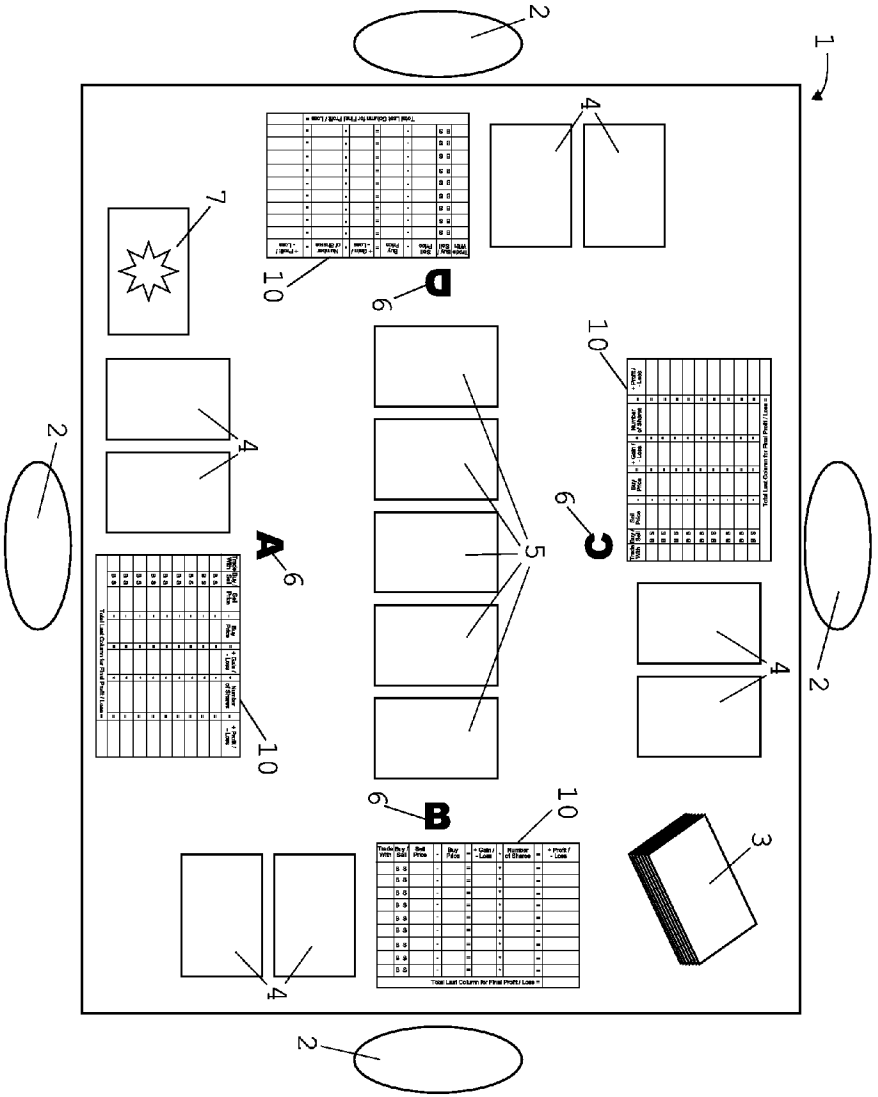
FIG. 3 various elements used in a particular market trading simulation configuration for casual game play, wherein trades are tracked by participants on their own tally sheets.
Figure 4:
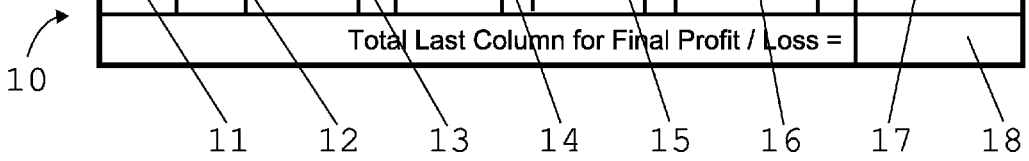
FIG. 4 illustrates a particular tally sheet for tracking each participant's trades during the simulation.
Figure 5:
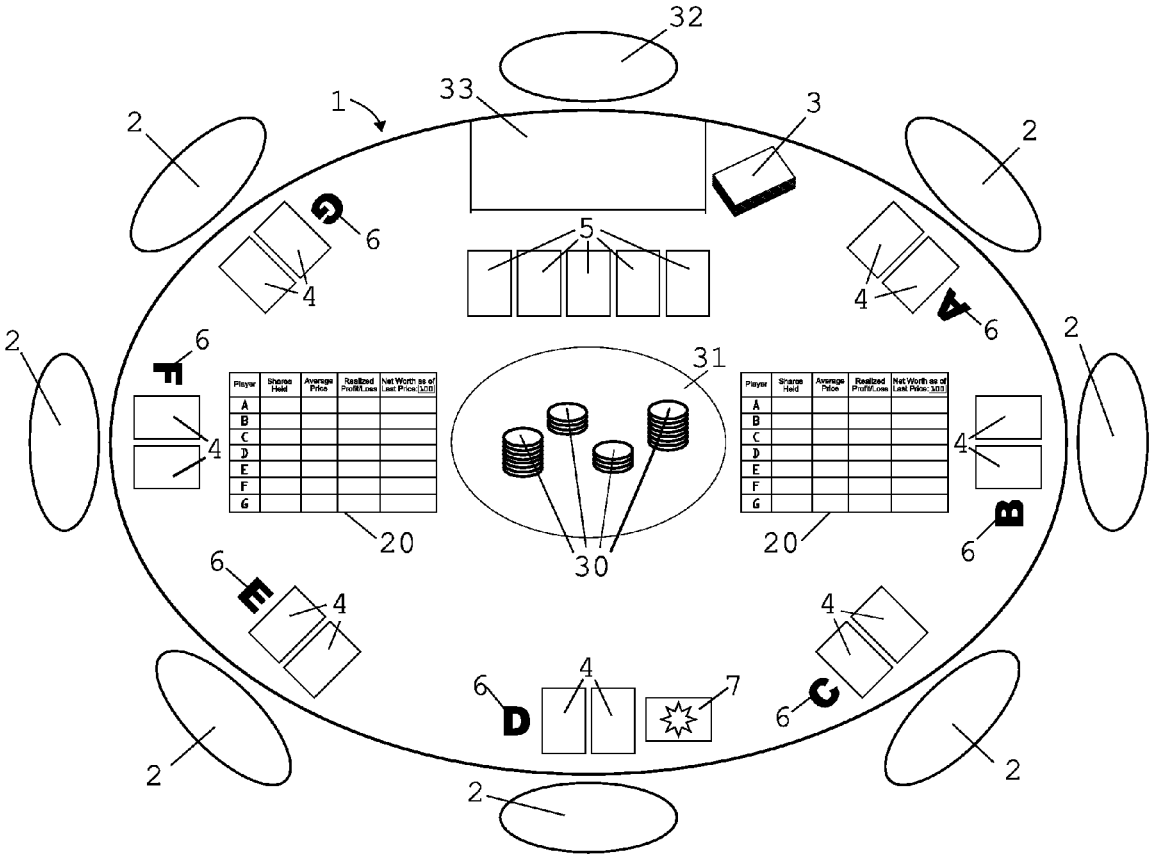
FIG. 5 illustrates various elements used in a particular market trading simulation configuration suitable for casino play, wherein trades are tracked on behalf of participants, wherein their aggregated summary information is available to all participants.
Figure 6:
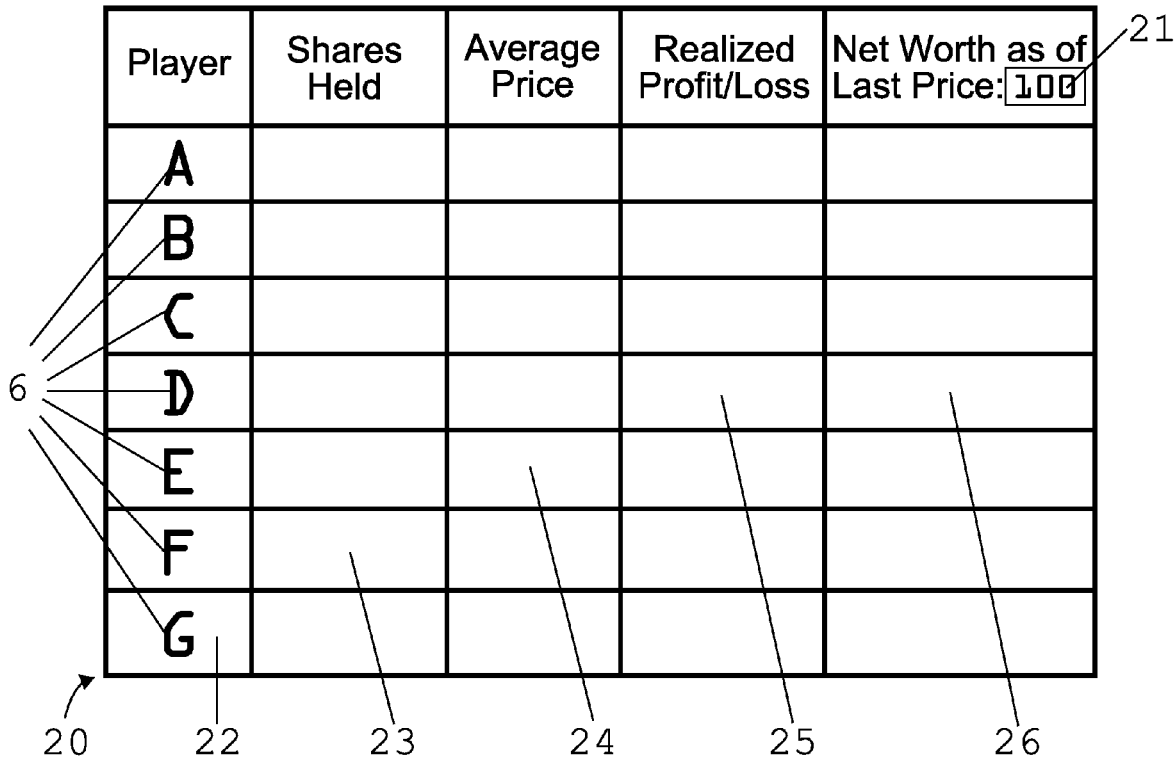
FIG. 6 illustrates a particular chart for displaying opposing participants and their aggregated summary information during the game simulation embodied in FIG. 5.

In at least one embodiment of the instant market trading simulation gaming invention, as partially illustrated in FIG. 3, a participant 2 or non-participant 32 (i.e. dealer, see FIG. 5) shuffles the deck 3 and deals two cards face-down on the layout 1 to each participant 2, forming their private information 4 that will contribute to the final settling price of the simulated security. Also illustrated in FIG. 1 of this particular embodiment, in the center of the layout 1 is the shared information 5, wherein said shared information comprises five graphically generated downward facing cards and that may contribute to the final settlement price of the simulated security. Note for purposes of this particular embodiment, the cards comprising the shared information 5, are dealt by either the participant 2 or dealer 32. The participant 2 or dealer 32 then announces the starting price for the simulation (commonly said starting price is a value of 100). Further, shown in FIG. 1, is wherein a participant 2 or dealer 32 designates a second participant 2 to that participant's left as the party responsible for starting the simulation, optionally giving that person a distinctive marker 7. In other embodiments, no participant 2 is designated as responsible for starting the simulation.

In at least one embodiment of the instant invention, a following step involves a participant 2 or dealer 32 setting aside the deck of remaining unused cards 3 without being allowed to view the remaining unused cards (as they will not be used in the simulation).

In at least one embodiment of the instant invention, a following step involves each participant 2 looking at their private cards 4 and considering the impact those cards will have when they are unveiled and contribute to the final settlement price. Each participant 2 then calculates their own estimate of the final settlement price at the end of the game. The actual settlement price will in this particular embodiment be calculated by applying all the shared information 5 and private cards' 4 values to the simulation's starting price.

FIGS. 3-8 substantially illustrate various embodiments of the trade simulation game, wherein once a game is open for a round of trading each round substantially proceeds by performing the substantially non-linear market making and trading steps described in the paragraphs below.

In at least one embodiment of the instant invention, the simulation allows for participants 2 and optionally dealers 32 to place wagers 30 (see FIG. 5) on the simulation before, during or after each round of trading.

In at least one embodiment of the instant invention a participant 2 responsible for starting the simulation and designated by the distinctive card 7 is required to be the first to "make a market", offering a price at which they will buy shares of the simulated stock 62 and a price at which they will sell shares of the simulated stock 63 (note stock market traders use the word "bid" to refer to the lower buy price and the word "ask" to refer to the higher sell price).

In at least one embodiment of the instant invention any participant 2 may make their own market by offering any buy/bid 62 and sell/ask 63 prices they choose.

In at least one embodiment of the instant invention, at least one participant 2 may retract or modify their bid 62 and ask 63 prices at any time during the simulation, but if another participant 2 accepts their bid or ask price prior to the retraction or modification, the offering participant 2 must trade with the accepting participant 2 at the offered price.

In at least one embodiment of the instant invention, every offer a participant 2 makes must include both a buy/bid 62 and a sell/ask price 63, wherein no restriction is made on whether these offers are better or worse than other existing offers made by other players.

In at least one embodiment one of the instant invention, a participant 2 to be offering the best (highest) buy/bid price 62 and another participant 2 may substantially simultaneously be offering the best (lowest) sell/ask price 63.

Figure 7:
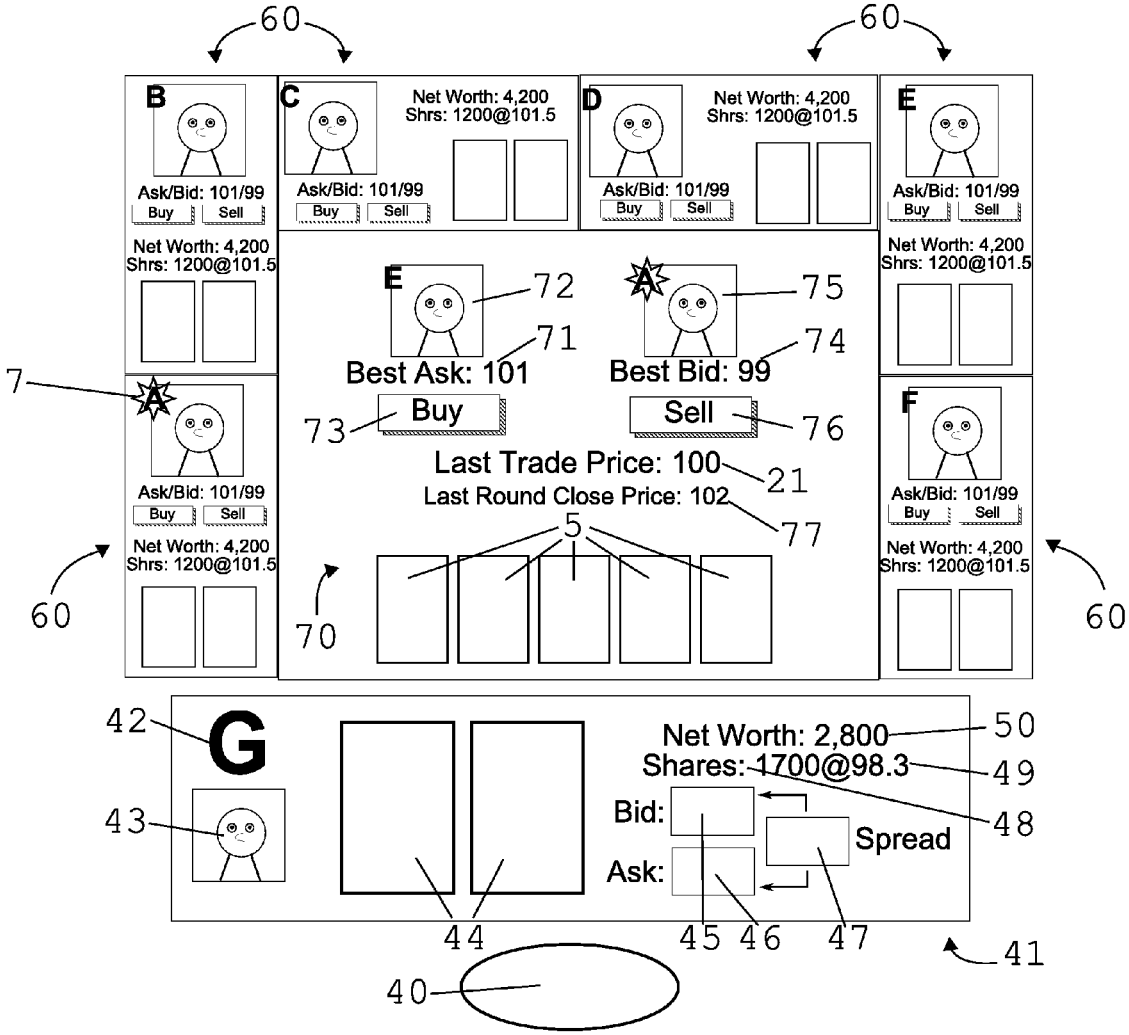
FIG. 7 illustrates a diagram layout of one embodiment of a multi-player trading game system from one game participant's perspective, wherein that participant manages their own information and game materials.
Figure 7A:
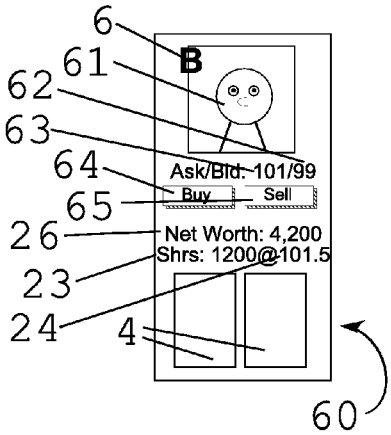
FIG. 7A illustrates one graphical embodiment for displaying an opposing participant's status in the multi-player trading game system illustrated in FIG. 7.
Figure 7B:
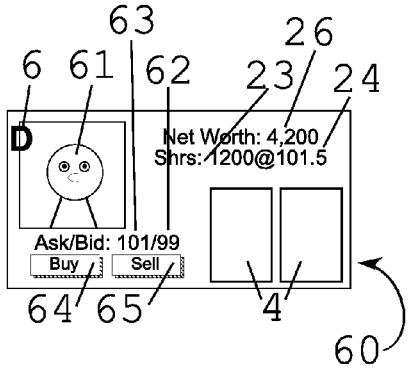
FIG. 7B illustrates a second graphical embodiment for displaying an opposing participant's status in the multi-player trading game system illustrated in FIG. 7.

In at least one embodiment of the instant invention, the layout area 70 comprises and indicates the best (highest) bid 74 and the best (lowest) ask 71, wherein graphical user interactive devices (such as a buy button 73 and such as a sell button 76) are provided for conveniently accepting those best offers (see FIG. 7).

In at least one embodiment of the instant invention, any participant 2 may accept the bid 62 or ask 63 of any other participant 2.

In at least one embodiment of the instant invention, this acceptance can be made verbally or with the aid of graphical user interactive devices (such as a user centric buy button 64) or (such as a user centric sell button 65). The quantity of the trade is confirmed, and in some embodiments, the most recent trade price 21 is updated.

In at least one embodiment, each participant 2 records the transaction on their own trade tally sheet 10 (see FIG. 4), recording:

- a unique indicator 6 of the participant 2 they traded with in the corresponding box in the Trade With column 11;
- an indicator of whether the recording participant was the buyer or the seller in the corresponding box in the Sell/Buy column 12;
- the sale price 62 (bid price) of another participant 2, into its corresponding box in the Sell Price column 13 in instances when the recording participant 2 was the seller;
- the purchase price 63 (ask price) of another participant 2, into its corresponding box in the Buy Price column 14 in instances when the recording participant 2 was the buyer; and
- the number of shares traded into the corresponding box in the Number of Shares column 16.

In at least one embodiment, each participant's aggregate information 20 (see FIG. 4) may be updated when a trade takes place, wherein said aggregate information 20 comprises:

- a Player column 22 for displaying a unique identifier 6 for each participant 2;
- a Shares Held column 23 for displaying the total positive, negative, or zero quantity of purchased and not sold or sold and not purchased shares by each simulation participant 2;
- an Average Price column 24 for displaying an average price each simulation participant 2 bought or sold their quantity of shares for 23;
- a Realized Profit/Loss column 25 for displaying any interim profit or loss realized by each simulation participant 2 at substantially the current time in the simulation; and
- a Net Worth as of Last Price column 26 for displaying the dynamic estimated grand total profit or loss for each simulation participant 2, based on the last trade price 21.

In at least one embodiment of the invention the simulation round continues with participants 2 that are optionally making bid 62 and ask 63 offers based on their own estimates of the final settlement price, wherein said participants 2 are dynamically informed with information comprising:

- information about participant's 2 private cards 4 provided in the bid 62 and ask 63 prices of other participants 2;
- observed prices at which each participant 2 trades; and
- odds of seeing cards that haven't been unveiled at the current point in the simulation.

The market making and trading continues until no participant 2 is still willing to modify their bid 62 and/or ask 63 prices to entice a trade. The trading round is then over and in particular embodiments the last trade price is recorded as the round's closing price 77.

In at least one embodiment of the instant invention a participant 2 or dealer 32 turns over a shared card 5, unveiling a value that may have an effect on the final settlement price when it is applied to the simulation's starting price during the final phase of the simulation. In this embodiment a participant 2 designated by the distinctive card 7 is responsible for starting the simulation, wherein said distinctive card 7 and the responsibility for starting the simulation associated with said distinctive card 7 is passed clockwise. With this new shared card unveiled, each participant 2 updates their estimate for the final settlement price, and the next round of trading begins as specified above.

When all shared cards 5 are unveiled, in at least one embodiment of the instant invention allows for each participant 2 to unveil one of their two private cards 4. In this embodiment a participant 2 designated by the distinctive card 7 is responsible for starting the simulation, wherein said distinctive card 7 and the responsibility for starting the simulation associated with said distinctive card 7 is passed clockwise. With this new shared card unveiled, each participant 2 again updates their estimate for the final settlement price, and the final round of trading begins as specified above.

After the last round of trading ends, all remaining face-down private cards 5 are unveiled, and the simulation's final settlement price is calculated by applying all dealt cards' values to the simulation's starting price. Then each participant 2 uses this final settlement price to sell any shares they purchased and to buy back any shares they sold during the simulation. In at least one embodiment of the instant invention, each participant 2 will use their own trade tally sheet 10 (see FIG. 4) to record:

- the final settlement price in the Sell Price column 13 in instances when the corresponding box in the Sell/Buy column 12 indicates the transaction was a buy;
- the final settlement price in the Buy Price column 14 in instances when the corresponding box in the Sell/Buy column 12 indicates the transaction was a sell;
- the per-share gain or loss for each trade in the Gain/Loss column 15, wherein the per-share gain or loss for each trade is determined by subtracting each trade's purchase price located in its corresponding box in the Buy Price column 14 from that trade's sale price, found in its corresponding box in the Sell Price column 13;

the profit or loss for each trade in the Profit/Loss column 17, calculated by multiplying each trade's per-share gain or loss located in its corresponding Gain/Loss column 15 by the number of shares traded, located in its corresponding Number of shares column 16; and the grand total profit or loss for a participant 2 in the Total Profit/Loss box 18, calculated by summing all of the individual trades' profits or losses located in the Profit/Loss column 17.

In at least one embodiment of the invention, all participants 2 announce their grand total profit or loss, and the winner of the simulation is the participant 2 with the most profits. Since all participants 2 traded in a closed simulation only with other participants 2, the sum total of all participants' 2 grand total profits or losses located in the Total Profit/Loss box 18 will be exactly zero.

Figure 8:
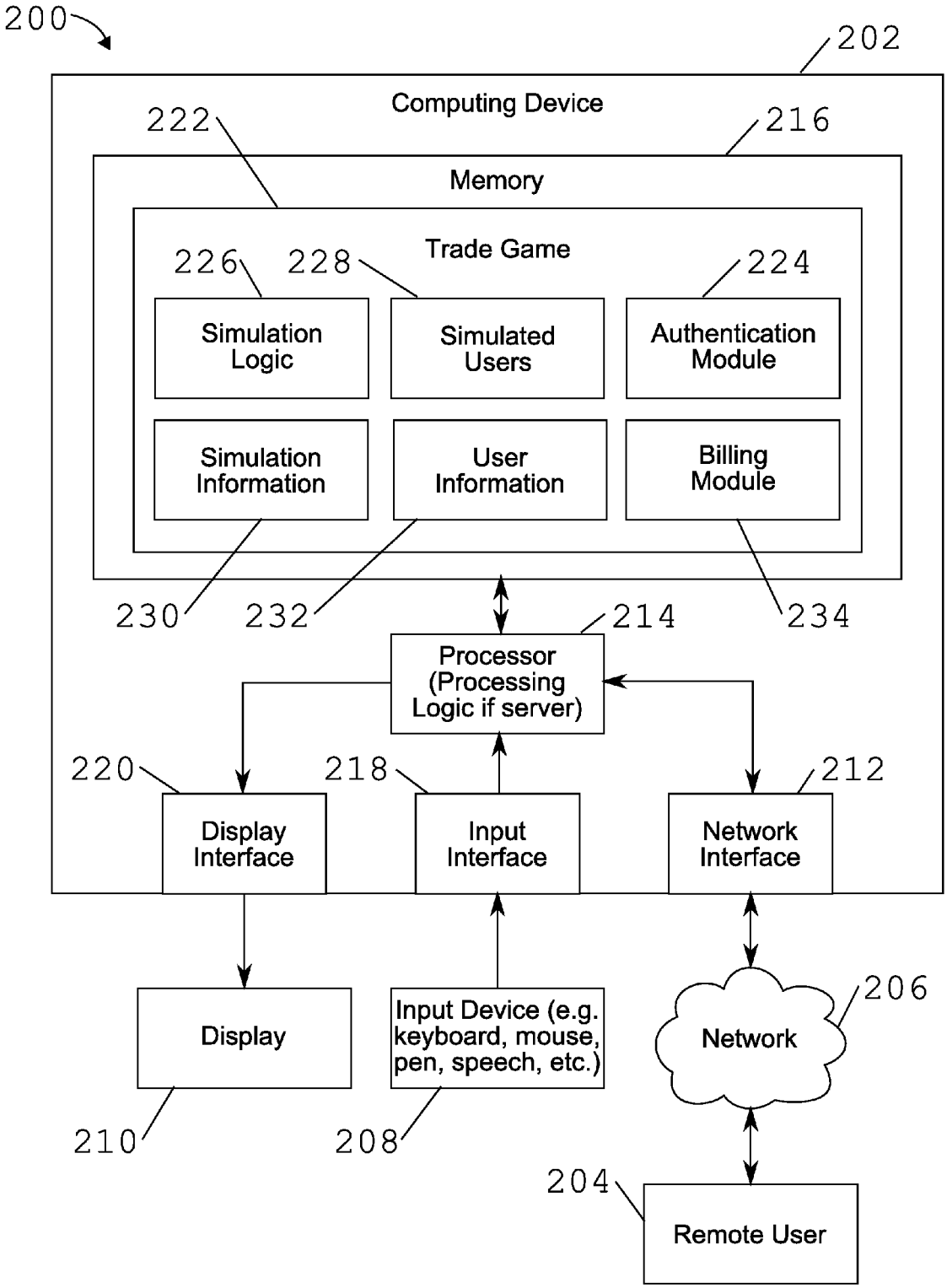
FIG. 8 illustrates one embodiment of a computing machine capable of executing the multi-player trading simulation.

FIG. 8 illustrates a block diagram of one embodiment of a trading game system 200. In this embodiment, the trading game system 200 comprises a computing device 202 that may be adapted to communicate with a remote device 204 via a network 206. In another embodiment, the computing device 202 may be a server system that is coupled to a wide area network (such as the Internet) and adapted to host a trading game for multiple distributed users via the network. In another particular embodiment, the trading game system 200 can be implemented without a network connection to allow a single user to play against the computer (i.e., against simulated users 228).

The computing system 202 is adapted to receive input from an input device 208, such as a keyboard, a mouse, a stylus, another input device, or any combination thereof. Further, the computing system 202 can transfer data to a display device 210. In various embodiments, the computing system 202 is a personal computer, a portable electronic device, or any combination thereof. In other embodiments, the computing system 202 is personal digital assistant (PDA), a portable phone, a media player (adapted to process audio, video, text, or any combination thereof), another portable electronic device, or any combination thereof. Further, in various embodiments the display device 210 can be integrated with the computing system 202.

The computing system 202 includes a network interface 212 that is adapted to communicate with the network 206 and includes a processor 214 that is coupled to the network interface 212. Further, the computing system 202 includes an input interface 218 adapted to receive user inputs from the input device 208. Additionally, the computing system 202 includes a display interface 220 that is adapted to communicate display data to the display device 210. The processor 214 is also coupled to a storage device or memory 216, which is adapted to store instructions that are executable by the processor to perform the trading game. In a particular embodiment, the computing system 202 can be a server system that includes one or more servers and the processor 214 may be processing logic that is distributed across multiple servers. In this particular instance, an authentication module 224 can be integrated with the computing device 202 or the trade game 222 to authenticate users. Also in this particular instance, a billing module 234 can be integrated with the computing device 202 or the trade game 222 to coordinate payments to and from users such as those for access to the computing system and settling of wagers.

What is claimed is:

1. A computer-based method of simulating market trading for game play experience comprising the steps of:

using a computing machine to represent the randomizing of a plurality of sets of market information, wherein each member of said plurality of sets of market information is represented by at least one game playing card;

using a computing machine to represent associating at least one of said plurality of sets of market information to at least one player;

using a computing machine to represent declaring a starting market price;

using a computing machine to represent allowing for at least one individual player of said at least one player to observe at least one of said plurality of sets of market information associated to said at least one individual player;

using a computing machine to represent making an offer of at least one bid to at least other individual player of said at least one player by at least one other individual player of said at least one player; and using a computing machine to represent making an offer of at least one quantity of shares of said at least one bid to at least one individual player of said at least one player by at least one other individual player of said at least one player.

2. The computer-based method of simulating market trading for game play experience of claim 1, wherein said method further comprises the steps of using a computing machine to represent associating to at least one central information depository at least one of said plurality of sets of market information and using a computing machine to represent at least one member of said at least one player observing at least one of said plurality of sets of market information associated to said at least one central information depository, wherein said at least one of said plurality of sets of market information was associated with said central information depository during said step of associating to at least one central information depository at least one of said plurality of sets of market information.

3. The computer-based method of simulating market trading for game play experience of claim 2, wherein said method further comprises the steps of using a computing machine to represent making an offer of at least one ask to at least one individual player of said at least one player by at least one other individual player of said at least one player and using a computing machine to represent making an offer of at least one quantity of shares of said at least one ask to at least one individual player of said at least one player by at least one other individual player of said at least one player.

4. The computer-based method of simulating market trading for game play experience of claim 3, wherein said method further comprises the steps of:

using a computing machine to represent accepting an offer of said at least one bid made by at least one individual player by at least one other individual player;

using a computing machine to represent accepting an offer of said at least one quantity of shares of said at least one bid made by at least one individual player by at least one other individual player;

using a computing machine to represent accepting an offer of said at least one ask made by at least one individual player of said at least one player by at least one other individual player of said at least one player; and using a computing machine to represent accepting an offer of at least one quantity of shares of said at least one ask made by at least one individual player of said at least one player by at least one other individual player of said at least one player.

5. The computer-based method of simulating market trading for game play experience of claim 4, wherein said method further comprises the steps of:

using a computing machine to represent making at least one new offer of at least one bid by an individual player of said at least one player to at least one other individual player of said at least one player;

using a computing machine to represent making at least one new offer of at least one quantity of shares of at least one bid by at least one individual player of said at least one player to at least one other individual player of said at least one player;

using a computing machine to represent making at least one new offer of at least one ask by an individual player of said at least one player to at least one other individual player of said at least one player; and using a computing machine to represent making at least one new offer of at least one quantity of shares of at least one ask by at least one individual player of said at least one player to at least one other individual player of said at least one player.

6. The computer-based method of simulating market trading for game play experience of claim 5, wherein said method further comprises the steps of:

using a computing machine to represent revealing by at least one individual player of said at least one player at least one member of said plurality of sets of market information associated to said at least one individual player to all other individual players of said at least one player;

using a computing machine to represent calculating a final settlement price; and using a computing machine to represent closing open positions when final settlement price is determined by said at least one player.

7. The computer-based method of simulating market trading for game play experience of claim 6, wherein said method further comprises the steps of:

using a computing machine to represent designating one individual player with a starter role;

using a computing machine to represent allowing said designated one individual player with a starter role to begin the making of offers of said at least one bid;

using a computing machine to represent allowing said starter to begin the making of offers of said at least one ask;

using a computing machine to represent allowing said designated one individual player with a starter role to begin the making of offers of shares of at least one bid;

using a computing machine to represent allowing said designated one individual player with a starter role to begin the making of offers of shares of at least one ask;

using a computing machine to represent continuing to re-designate other individual players with said starter role, wherein one additional individual player is re-designated with said starter role after one turn of play; and using a computing machine to represent according accepted trade information, wherein said trade information comprises accepted quantity of shares and an accepted price.

* * * * *